United States Patent [19]

Hiyoshi et al.

[11] 4,114,497

[45] Sep. 19, 1978

[54] ELECTRONIC MUSICAL INSTRUMENT HAVING A COUPLER EFFECT

[75] Inventors: Teruo Hiyoshi; Akira Nakada; Shigeru Yamada, all of Hamamatsu; Kiyoshi Ichikawa, Hamakita; Sigeki Isii, Hamamatsu, all of Japan

[73] Assignee: Nippon Gakki Seizo Kabushiki Kaisha, Hamamatsu, Japan

[21] Appl. No.: 727,790

[22] Filed: Sep. 29, 1976

[30] Foreign Application Priority Data

Sep. 29, 1975 [JP] Japan ..... 50-117431

[51] Int. Cl.[2] ..... G10H 3/06

[52] U.S. Cl. ..... 84/1.17; 84/1.01; 84/1.11; 84/1.19

[58] Field of Search ..... 84/1.01, 1.03, 1.17, 84/1.11, 1.19

[56] References Cited

U.S. PATENT DOCUMENTS

| | | | |
|---|---|---|---|
| 3,565,995 | 2/1971 | Bunger | 84/1.17 |
| 3,708,602 | 1/1973 | Hiyama | 84/1.17 X |
| 3,803,338 | 4/1974 | Adachi | 84/1.17 |
| 3,929,051 | 12/1975 | Moore | 84/1.17 |

*Primary Examiner*—Ulysses Weldon
*Attorney, Agent, or Firm*—Spensley, Horn & Lubitz

[57] ABSTRACT

An electronic musical instrument is of a type wherein musical tone waveforms are stored in a memory as their sampled amplitudes and sequentially and repetitively read out to constitute tone waveforms. A key depression brings forth key code in a digital representation. This key code is used for reading out frequency information from a frequency information memory. The frequency informaton is accumulated to make an address signal for reading out the waveform memory. The read out waveform is reproduced as a musical tone through a tone-color and volume control circuit. This tone-color and volume control circuit is controlled keyboard by keyboard.

The key code produced upon depression of the key contains a signal representing the kind of the keyboard to which the depressed key belongs. This signal is applied to a conversion circuit and converted to a signal representative of a different kind of keyboard. The output signal of the conversion circuit operates the tone-color and volume control circuit in a manner corresponding to the keyboard designated by the converted signal while the original signal representing the kind of the keyboard of the depressed key is applied directly to the tone-color and volume control circuit to operate it in a manner corresponding to the keybord of the depressed key. The manner of conversion of the signal representing the keyboard can be selected as desired. There is disclosed an example of a coupler effect between the upper and lower keyboard which can be produced by converting a signal for the upper keyboard to a signal for the lower keyboard while directly using the upper keyboard signal. Also disclosed is an example of a coupler effect between the lower keyboard and the pedal keyboard produced by converting a signal for the lower keyboard to a signal for the pedal keyboard while directly using the lower keyboard signal.

6 Claims, 4 Drawing Figures

ELECTRONIC MUSICAL INSTRUMENT HAVING A COUPLER EFFECT

BACKGROUND OF THE INVENTION

This invention relates to an electronic musical instrument capable of producing a coupler effect between different keyboards.

In a digital type electronic musical instrument, tone-color, tone pitch, volume or footage register of a musical tone is controlled keyboard by keyboard. More specifically, if a certain keyboard is played, a musical tone is produced with a tone-color, tone pitch, volume and footage register specifically set for that keyboard.

The prior art digital type electronic musical instrument, however, is incapable of producing a coupler effect between keyboards, that is, an effect provided by producing a tone of a keyboard other than a keyboard which is actually played simultaneously with a tone of the actually played keyboard and thereby imparting impression as if the two keyboards were being played simultaneously. The prior art electronic musical instrument therefore is handicapped in playing performance in this respect.

SUMMARY OF THE INVENTION

It is an object of the present invention to provide an electronic musical instrument capable of producing the coupler effect between keyboards with a simple construction.

An electronic musical instrument to which the present invention is applied is a type wherein a musical tone is produced on the basis of a code signal representing a key depressed on a keyboard and signals respectively representing depression and release of the key, and desired tone-color, tone pitch, volume and footage are selected by utilizing a signal representing the kind of keyboard contained in the code signal. According to the invention, a signal representing the keyboard to which a depressed key belongs is converted to a signal representing a different keyboard, and tone-color, tone pitch, volume and footage of each of two (or more) keyboards are respectively selected on the basis of both the converted signal and the original signal for the actually depressed key. The coupler effect is achieved by producing tones of the selected keyboards simultaneously.

The invention will now be described with reference to the accomplanying drawings.

DESCRIPTION OF THE PREFERRED EMBODIMENTS

Figure 1:
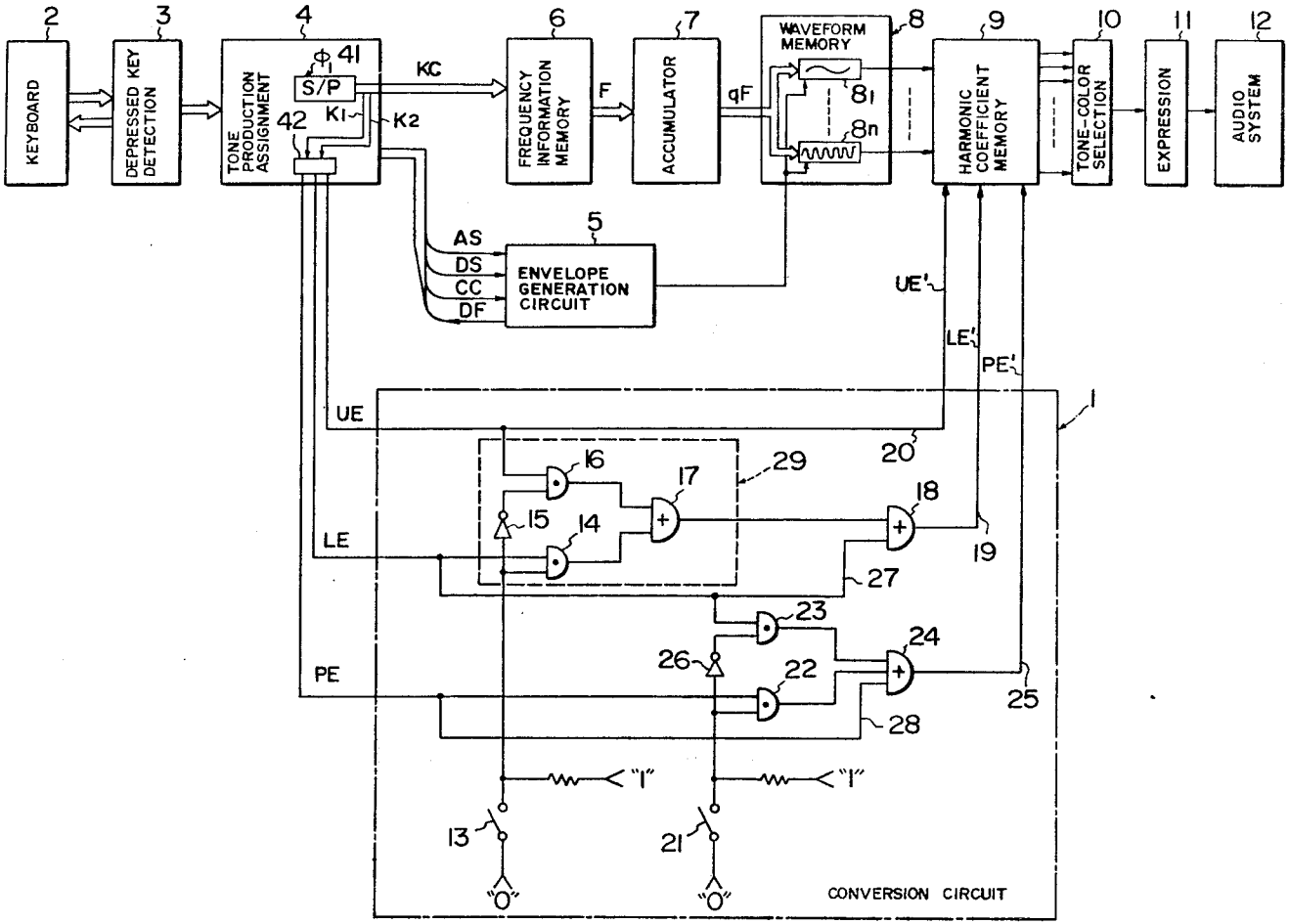
FIG. 1 is a block diagram showing a preferred embodiment of the electronic musical instrument according to the invention.

Referring first to FIG. 1, which shows one preferred embodiment of the electronic musical instrument of the present invention for achieving the coupler effect between the keyboards with regard to a tone-color and footage register, a conversion or converter circuit 1 converts the signals UE, LE and PE representing the kinds or sorts of the keyboards of the depressed keys supplied from a tone production assigner or assignment circuit 4 to the signals UE', LE' and PE', respectively, representing the keys of the other keyboards. The conversion circuit is constructed in such a manner that in case where the coupler effect between the upper and the lower keyboards for example is desired, when the key or keys of the upper keyboard are depressed, the upper keyboard signal UE becomes "1" and is converted into a lower keyboard designation signal LE' in the conversion circuit 1 with the result that both the upper keyboard designation signal UE' and the lower keyboard designation signal LE' become "1". The particular of the conversion circuit 1 will hereinbelow be described in greater detail. The entire circuit arrangement of the electronic musical instrument of the present invention will now be first described.

A depressed key detection or detector circuit 3 detects the on or off actuation of the respective key switches corresponding to the keys disposed at the keyboards 2 and thereby produces information for identifying the depressed key or keys. The tone production assignment circuit 4 receives the information for identifying the keys thus depressed from the depressed key detection circuit 3 and assigns production of the tones of the key or keys indicated by the information to any of the channels of the same number as a maximum vailable number of musical tones to be simultaneously produced (e.g., 12 channels as in the present embodiment). The tone production assigner 4 comprises storing positions defining the respective channels for storing key codes KC representative of the keys at the storing positions corresponding to the channels to which the production of tones of the keys are assigned and successively and sequentially outputs the key codes KC stored at the respective channels in a timesharing manner. Accordingly, in case a plurality of keys are simultaneously depressed at the keyboards 2, the tones of the depressed keys are separately assigned to the respective channels in such a manner that the key codes KC indicative of the assigned tones of the depressed keys are stored at the storing positions defining the respective channels. The respective storing positions may preferably consist of a circulating shift register 41. For example, assume that the key codes KC specifying the respective keys at the keyboards 2 consist of a suitable number of bits, e.g., 9 bits as in the present embodiment shown in the following Table I. Two bits of the 9 bits represent code $K_2$ and $K_1$ indicative of the kind or type of the keyboards, three bits of the 9 bits rerpesent codes $B_3$, $B_3$ and $B_1$ indicative of octave range, the rest four bits thereof represent codes $N_4$, $N_3$, $N_2$ and $N_1$ indicative of the musical notes within an octave and that the number of the entire channels is 12. There may be employed a 12-stage/9-bit shift register.

Table I

| Kinds of Keys | | Key Codes KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboards | Upper Keyboard | 0 | 1 | | | | | | | |
| | Lower Keyboard | 1 | 0 | | | | | | | |
| | Pedal Keyboard | 1 | 1 | | | | | | | |
| Octave | 1st | | | 0 | 0 | 0 | | | | |
| | 2nd | | | 0 | 0 | 1 | | | | |
| | 3rd | | | 0 | 1 | 0 | | | | |

Table I-continued

| Kinds of Keys | | Key Codes KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Range | 4th | | | 0 | 1 | 1 | | | | |
| | 5th | | | 1 | 0 | 0 | | | | |
| | 6th | | | 1 | 0 | 1 | | | | |
| Musical Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

In order for this embodiment to enable the electronic musical instrument to produce a plurality of musical tones simultanesouly, the instrument is constructed as a dynamic logic circuit system wherein the logics, the counters, the memories, etc. are commonly used in a time-division manner so that the time relation of the clock pulses for controlling the operation of the instrument is very important. FIG. 2(a) denotes a graph of main clock pulses $\phi_1$, which control the time-sharing operations of the respective channels and which, for example, has a pulse period of 1 $\mu$s. Since this embodiment of the electronic musical instrument of the present invention has 12 channels, the respective time slots with a pulse width of 1 $\mu$s partitioned by the main clock pulses $\phi_1$ sequentially correspond to first to twelfth channels, respectively. As illustrated in FIG. 2(b), the respective time slots will hereinafter be referred successively to as "first to twelfth channel times". The respective channel times will appear cyclically. Therefore, the key codes KC indicating the keys are stored in the storing positions, defining the channels to which the tones of the keys produced are assigned by the tone production assignment circuit 4, i.e., the key codes KC are stored in the aforesaid shift register, and in turn are sequentially outputted in coincidence with the channel times thus assigned in a time sharing fashion. It is for example assumed that the musical note C of the second octave range of the pedal keyboard is assigned to the first channel, the musical note G of the fifth octave range of the upper keyboard to the second channel, the musical note C of the fifth octave tone range of the upper keyboard to the third channel, the misucal note E of the fourth octave tone range of the lower keyboard to the fourth channel, and no musical note is assigned to the fifth to twelfth channels. The key codes KC outputted in synchronization with the respective channel times in a time-sharing manner from the tone production assigner circuit 4 becomes as indicated in FIG. 2(c). The outputs from the fifth to twelfth channels are all "0".

The tone production assignment circuit 4 also produces an attack start signal or key-on signal AS representing that the musical tone should be produced at the channel to which the tone of the key is assigned upon depression of the key in synchronization with the respective channel times in a time-sharing manner. The tone production assigner circuit 4 further produces a decay start signal or key-off signal DS indicating that the musical tone should decay at the channel to which the tone of the key is assigned upon release of the key depressed in synchronization with the respective channel times in a time sharing fashion. These signals AS and DS will be utilized in an envelope generation or generator circuit 5 for controlling the amplitude of the envelope of the musical tones i.e., (or controlling the tone production). The tone production assignment circuit 4 receives from the envelope generation circuit 5 a decay finish signal DF representing that the tone production at the corresponding channel is finished and thereupon produces a clear signal CC for clearing the various memories with respect to the corresponding channel based on the decay finish signal DF so as to completely eliminate the tone production assignment. The tone production assigner circuit 4 also produces the keyboard signals UE, LE and PE indicating which keyboard the depressed key belongs to in synchronization with the outputs of the key codes KC. The identification of the key coder KC in relation to the kind of the keyboard can be made by the digits $K_2$ and $K_1$ of the code indicating the kind of the keyboard. Consequently, either of the respective keyboard signals UE, LE and PE can be determined by decoding the codes $K_2$ and $K_1$ of the output key codes KC from the shift register 41 by a decoder 42. In case, for example, of FIG. 2(c), the pedal keyboard signal PE becomes "1" at the first channel time as illustrated in FIG. 2(f), the upper keyboard signal UE becomes "1" at the second and third channel times as indicated in FIG. 2(d), and the lower keyboard signal LE becomes "1" at the fourth channel time as shown in FIG. 2(e). Assume, for example, that the keys assigned to the first and second channels remain depressed, the keys assinged to the third and fourth channels are released and the corresponding tones are decaying, the tone production is finished at the fourth channel at the time slot $t_1$ with the decay finish signal DF being produced, and the clear signal CC is produced at the time slot $t_2$ after the delay of 12 channel times from the time slot $t_1$ as in the example shown in FIG. 2(c). The respective signals AS, DS, DF and CC are produced as illustrated in FIGS. 2(g) through 2(j). As the tone production assignment circuit 4 produces the clear signal CC at the time slot $t_2$, the attack start signal AS and the decay start signal DS are eliminated at the fourth channel. Simultaneously, the key codes KC and the lower keyboard signal LE shown in FIGS. 2(c) and 2(e), respectively are also deleted at the fourth channel, but they are not erased from the drawings for convenience of explanation.

Figure 2:
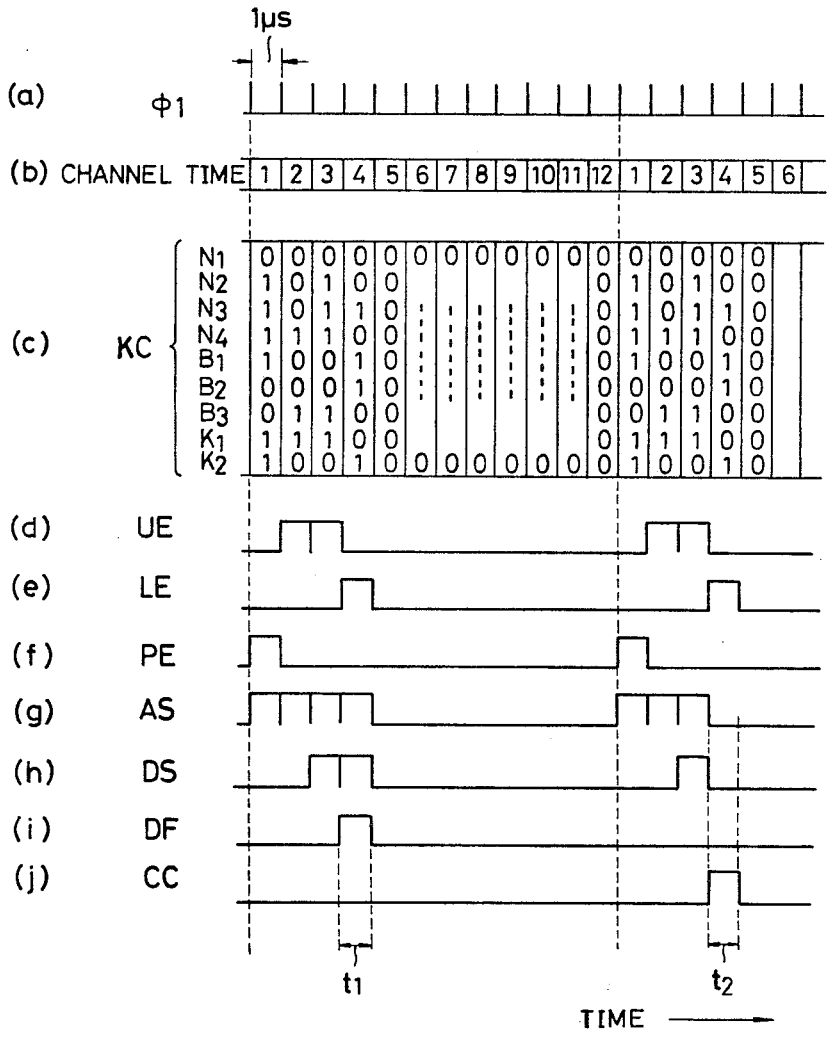
FIGS. 2(a) through 2(j) are timing charts for explaining operation of a tone production assignment circuit 4.

As will be apparent from FIG. 2, a specific channel to which the various signals KC, AS, DS, CC, UE, LE and PE produced by the tone production assigner circuit 4 are assigned can be known by the channel time.

The aforementioned tone production assignment circuit 4 and the depressed key detector circuit 3 will not further be described in detail. These circuits 3 and 4 may be the depressed key detection circuit and the key assigner, respectively of the types disclosed in U.S. Pat. No. 3,882,751 entitled "Electronic musical instrument" issued and assigned to the same assignee as in the present invention. These circuits 3 and 4 may also be constructed by the circuit arrangements other than the arrangements disclosed as described above within the spirit and scope of the present invention, but they will not be described in any greater detail.

It is to be noted that since the key codes KC produced by the tone production assignment circuit 4 represent the depressed keys, these key codes KC are utilized as address designation signals for reading out the numerical information instrinsic for the frequencies of the musical tones of the keys corresponding to the key codes KC from a frequency information memory 6.

The frequency information memory 6 is constructed by, for example, a read-only memory (ROM) for storing the frequency information F (constants) corresponding to the key codes KC of the respective keys in advance, which read-only memory serves the functions of reading out the frequency information F stored at the addresses designated by the codes upon receipt of a certain key code KC. The frequency information memory 6 is not limited only to this type of ROM but may also adopt other than this within the spirit and scope of the present invention. A frequency information accumulator 7 regularly makes a cumulative addition of the frequency information F and samples the amplitude of the musical tone waveform at every predetermined constant time. Accordingly, the frequency information F being of digital number proportional to the frequencies of the musical tones of the corresponding keys such as, for example, binary number of 15 bits as disclosed in the specification of U.S. Pat. No. 3,882,751 entitled "Electronic musical instrument" assigned to the same assignee as in the present invention. This frequency information F for each frequency consists of a suitable number of bits, e.g. 15 as in the present embodiment, and represents numerals including fraction section in a radix point notation. The most significant bit of the 15 bits indicates an integer section and the rest of the bits, i.e., 14, represents a fraction section.

The value of the frequency information F may be unitarily determined at a certain constant sampling speed if the value of the frequency of the musical tone is specified. For example, assume that when the value $q$F cumulatively added with the information F by the frequency information accumulator 7 becomes 64 in a decimal notation, the sampling of the one musical tone waveform is completed (where $q = 1, 2, \ldots$) and also that this cumulative addition is achieved every 12 $\mu$s when the entire channel times are cyclically circulated once. The value of the frequency information F can be determined in accordance with the following equation:

$$F = 12 \times 64 \times f \times 10^{-6}$$

where $f$ signifies the frequencies of the musical tones. It will be understood that the frequency information F is stored in the frequency information memory 6 in accordance with the frequency $f$ to be obtained.

The frequency information accumulator 7 serves the functions of cumulatively counting the frequency information F of the respective channels at a predetermined constant sampling speed, e.g., at 12 $\mu$s per respective channel times in the present embodiment for obtaining the accumulated value $q$F so as to advance the phase of the musical tone waveform to be read out at every sampling time (12 $\mu$s). When the accumulated value $q$F reaches 64 in a decimal notation, the frequency information accumulator 7 overflows to return to zero to thus complete the reading of one waveform. Since 64 in a decimal notation can be represented by 6-bit binary number, the frequency information accumulator 7 is so constructed by a counter or accumulator of 20 bits in one word wherein the first to fourteenth bit represent the fraction section and fifteenth to twentieth bits represent the integer section as to hold the accumulated result until the frequency information F with the fifteenth bit being the unit place of the integer section is cumulatively added in such a manner that the accumulated value $q$F becomes 64. It should be noted that the frequency information accumulator 7 is constructed by 12-stage/20-bit shift register together with 20-bit adder commonly used at the respective channels in a time-sharing manner.

A musical tone waveform memory 8 stores a musical tone waveform by storing sequential amplitudes at respective sample points obtained by dividing the musical tone waveform by a suitable number of sample points such as 64. The accumulated value $q$F produced from the frequency information accumulator 7 becomes the input for designating the addresses for reading contents of the musical tone waveform memory 8. Since the number of addresses of the waveform memory 8 is 64, the data of the fifteenth to twentieth bits of 20 bits corresponding to the integer section of the accumulated value $q$F are adapted to be applied to the waveform memory 8 as the address input thereto. On the other hand, the data of the first to fourteenth bits of 20 bits corresponding to the fraction section of the accumulated value $q$F is merely utilized in the frequency information accumulator 7 for the cumulative addition thereof.

According to the present invention, a harmonic coefficient memory 9 synthesizes necessary harmonics with predetermined relative amplitudes so as to provide desired tone-color the musical tone. This necessitates the musical tone waveform memory 8 and have $n$ waveform memories $\mathbf{8}_l$ to $\mathbf{8}_n$, which store waveforms in harmonic relations to each other. More specifically, the waveform memories $\mathbf{8}_l$ to $\mathbf{8}_n$ separately store sinusoidal waveforms, respectively corresponding to the respective $n$ harmonic frequencies. The orders of the respective harmonics thus stored are for example 1 (fundamental wave frequency), 2, 3, . . . , $n$.

The aforementioned waveform memories $\mathbf{8}_l$ through $\mathbf{8}_n$ serves the functions of reading out the amplitudes of the sampled waveform points in analog value in response to the digital address inputs. These waveform memories $\mathbf{8}_l$ through $\mathbf{8}_n$ may be the memories of the type disclosed in U.S. Pat. No. 3,890,602 entitled "Semiconductor waveform memory". More particularly, the above described waveform memories $\mathbf{8}_l$ through $\mathbf{8}_n$ may, for example, be so constructed as to freely produce the voltages of the amplitudes of the respective sampled waveform points with the switching operation of electronic switching element group in response to the inputs of the digital address signals as desired for reading out the voltages of the amplitudes of the sampled points designated by the addresses.

According to the present invention, the respective waveform memories $\mathbf{8}_l$ through $\mathbf{8}_n$ are adapted to be simultaneously read out at the same addresses and are thus constructed in such a manner that the number of the waveforms stored in the respective memories $\mathbf{8}_l$ through $\mathbf{8}_n$ may not always be one waveform (i.e., one cycle) but the number of the waveforms (i.e., the number of cycle) responsive to the order of the harmonics is stored therein. For example, the waveform memory $\mathbf{8}_l$ stores a sinusoidal waveform (one cycle) at 64 sampling points, and the memory $\mathbf{8}_n$ stores $n$ sinusoidal waveform ($n$ cycles) at 64 sampling points.

Thus, the musical tone waveform memory 8 functions to produce $n$ kinds of sinusoidal wave signals the frequencies of which are in a harmonic relationship with each other. More specifically, the musical tone waveform memory 8 produces plural sorts of harmonic frequencies in parallel simultaneously. The levels of these harmonic frequencies of the musical tones are the same with each other. Accordingly, the levels of the respective harmonic frequencies of the musical tones are controlled by the harmonic coefficient memory 9 and are then so mixed thereby as to obtain desired tone-color.

Figure 3:
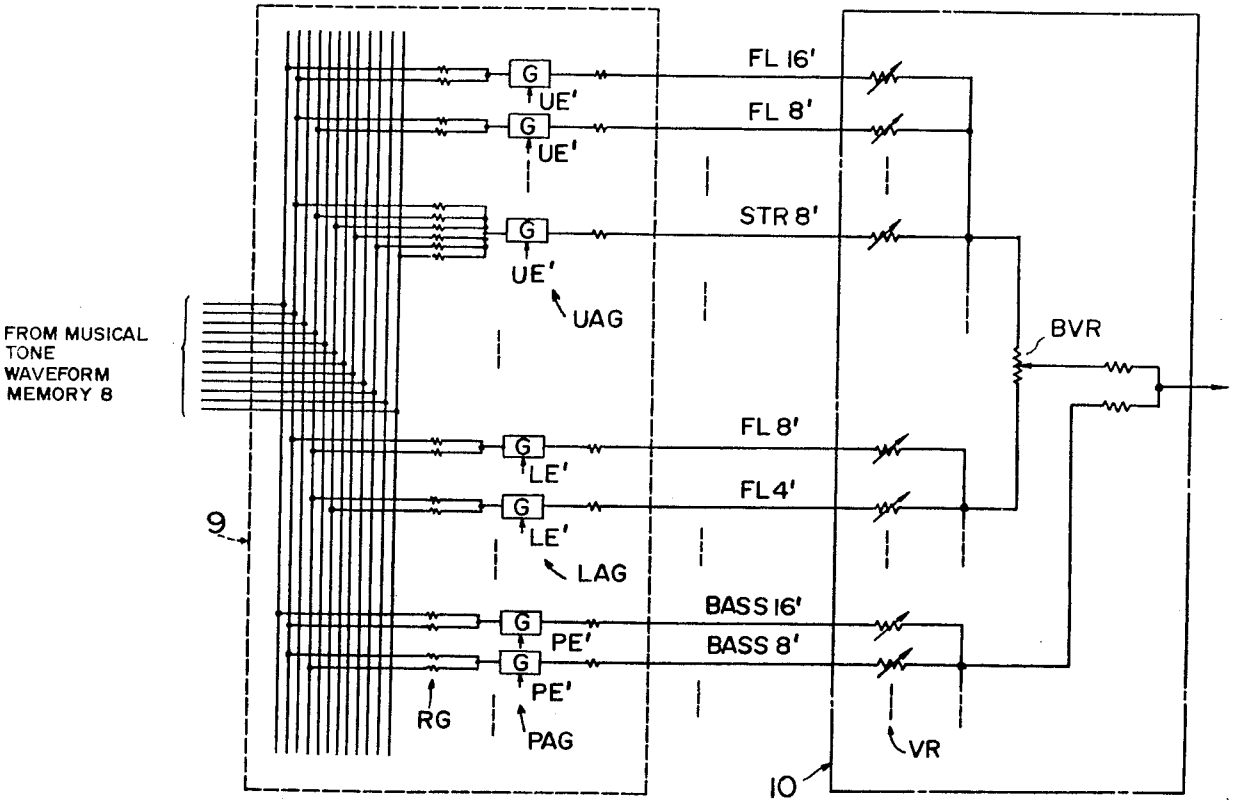
FIG. 3 is a circuit diagram showing a part of tone-color control portion of the embodiment shown in FIG. 1.

FIG. 3 illustrates one preferred example of the tone-color control unit employed in the circuit arrangement of the electronic musical instrument according to the present invention. As denoted in FIG. 3, the harmonic coefficient memory 9 comprises a plurality of resistance mixture or mixing circuits and a plurality of analog gate circuits. In order that the musical tones may obtain desired tone-color, *n* harmonic frequency signals are mixed by the resistance or resistor group RG in the desired combination and level. It will be understood by those skilled in the art that the resistances of the respective resistance or resistor elements in the resistor group RG depend upon necessities as desired in a manner different from each other. Thus, the coefficients of the amplitude level of the respective harmonic frequencies of the musical tones from the musical tone waveform memories $\mathbf{8}_l$ through $\mathbf{8}_n$ to be introduced to the above described resistor elements are determined by these resistance elements. More specifically, the harmonic frequencies of the orders required for accomplishing a desired certain tone-color are introduced to the resistance elements which are set in the relative amplitude levels of the respective harmonic components and are thus mixed in very tone-color and are then delivered to the respective analog gate circuits UAG, LAG and PAG, respectively. It is to be noted in the circuit arrangement of this embodiment that separate resistance mixture circuits are constructed in the resistor groups RG correspondingly to all the tone-colors to be achieved.

The outputs from the aforementioned resistance mixture circuits thus produced are fed to the analog gate circuits UAG, LAG and PAG, respectively. In addition, the above described combinations of the resistance mixture circuits and the analog gate circuits UAG, LAG and PAG are constructed in the respective keyboards, so that the tone-color controls can be performed in the respective types or kinds of the keyboards. For example, the upper and lower keyboards have respective various tone-color controls such as 4 foot flute FL4', 8 foot flute FL8', 16 foot flute FL16', 8 foot strings STR8', etc., and the pedal keyboard also has various tone-color controls such as 8 foot bass BASS8', 16 foot bass BASS16', etc.

In addition to the aforementioned circuit arrangement in this embodiment of the present invention, the upper keyboard designation signal UE', lower keyboard designation signal LE' and pedal keyboard designation signal PE' produced from the aforementioned conversion circuit 1 are applied to the gate control input sides of the corresponding analog gate circuits UAG, LAG and PAG, thereby opening the respective analog gate circuits AG under the control thereof. Therefore, all the musical tone waveforms of the tone-colors producible by the keyboards represented by the designation signals UE', LE' and PE' are simultaneously produced from the harmonic coefficient memory 9.

The outputs from the harmonic coefficient memory 9 are applied to tone-color selection circuit 10 of the respective keyboards. The tone-color selection circuit 10 serves the functions of selecting to mix the respective tone-colors applied from the harmonic coefficient memory 9 by the operation or manipulation of of variable resistance elements VR corresponding to the respective tone-colors producible in the respective keyboards. The variable resistance elements VR are provided in correspondence to the respective outputs of the aforementioned harmonic coefficient memory 9. The outputs of the respective variable resistance elements VR are grouped separately according to the respective keyboards. The outputs of the upper and lower keyboards are controlled in the volume balance by means of balance control variable resistance element BVR and are thereafter mixed with the output of the pedal keyboard.

The output of the tone-color election circuit 10 is controlled in volume by means of an expression circuit 11 and is then produced in the musical tones through an audio system 12.

Referring back to FIG. 1, the keyboard designation signals UE', LE' and PE' thus applied to the harmonic coefficient memory 9 from the conversion circuit 1 are formed by converting the keyboard signals UE, LE and PE applied from the tone production assignment circuit 4 to the conversion circuit 1.

More specifically, in FIG. 1, when an upper and lower keyboard coupler selection switch 13 is closed, a circuit arrangement is so constructed as to apply a signal "0" to an AND circuit 14 and also to simultaneously apply a signal "1" which is an inverted output of an inverter 15 to an AND circuit 16. Thus, the lower keyboard signal LE applied from the tone production assignment circuit 4 to one of the input terminals of the AND circuit 14 is blocked at the AND circuit 14, whereas the upper keyboard signal UE applied from the tone production assignment circuit 4 to one of the input terminals of the AND circuit 16 is passed through the AND circuit 16 and then through OR circuits 17 and 18 and is provided at the output line 19 of the conversion circuit 1 for the lower keyboard designation signal LE'. Thus, the signal UE representing the upper keyboard is converted by the conversion circuit 1 to the lower keyboard designation signal LE' for designating the lower keyboard and is thus supplied to the output line 19 of the conversion circuit 1. The upper keyboard signal UE is simultaneously delivered to the output line 20 of the conversion circuit 1 as it is and is applied to the harmonic coefficient memory 9 as the upper keyboard designation signal UE'.

Accordingly, when the upper and lower keyboard coupler selection switch 13 is closed, assuming that the key of the upper keyboard is depressed (the signal UE becomes "1"), both the upper and lower keyboard designation signals UE' and LE' become "1" with the result that the coupler effect of the upper and lower keyboards can thus be achieved. More particularly, the analog gate circuit groups UAG and LAG of the upper and lower keyboards are conducted by the upper and lower keyboard designation signals UE' and LE' in the harmonic coefficient memory 9 shown in FIG. 3. Thus, the entire musical tones capable of being produced in the upper and lower keyboards are supplied to the tone-color selection circuit 10. For example, in case where 8 foot flute tone FL8' is selected in the upper keyboard and 4 foot flute tone FL4' is selected in the lower keyboard by the variable resistance element VR of the tone-color selection circuit 10, the flute tones of 8 and 4 foot are mixed in the tone-color selection circuit 10 and the mixed tones of the 8 and 4 foot flute musical tones are thus delivered from the tone-color selection circuit 10. Thus, the coupler effect between the keyboards with regard to footage can be achieved. In case 8 foot strings tone STR8′ is selected in the upper keyboard and 8 foot flute tone FL8′ is selected in the lower keyboard in the same manner as described above, the mixed output of the strings and flute tone-colors are produced from the tone-color selection circuit 10, so that the coupler effect between the keyboards with respect to the tone-color can thus be performed.

Feferring also back to FIG. 1, when a lower and pedal keyboard coupler selection switch 21 is closed, a signal "0" is applied to an AND circuit 22, and a signal "1" which is an inverted output of an inverter 26 is applied simultaneously to an AND circuit 23. Accordingly, when the lower keyboard signal LE representing that the key or keys of the lower keyboard are depressed is applied from the tone production assignment circuit 4 to one of the input terminals of the AND circuit 23, the signal LE being "1" is passed through the AND circuit 23 and then through an OR circuit 24 and is provided at the output line 25 of the conversion circuit 1 for the pedal keyboard designation signal PE′ being "1". Simultaneously, the lower keyboard signal LE applied from the tone production assignment circuit 4 to one of the input terminals of the OR circuit 18 is also passed through the OR circuit 18 and is produced at the output line 19 of the conversion circuit 1 for the lower keyboard designation signal LE′ becoming "1". Then, the lower keyboard analog gate circuit group LAG and pedal keyboard analog gate circuit group PAG are opened by the lower and pedal keyboard designation signals LE′ and PE′ in the harmonic coefficient memory 9 shown in FIG. 3. Thus, the coupler effect between the lower and pedal keyboard tones can be achieved in the same manner as previously described.

In FIG. 3, in case where the coupler effect is removed, the keyboard coupler selection switches 13 and 21 will be opened as designated in the Figure. If these coupler selection switches 13 and 21 are thus opened, the signals "1" are applied to the inverters 15 and 26. Consequently, the signals "1" are inverted thereby and are then applied to the other one of the input terminals of the AND circuits 16 and 23 thereby ceasing to gate out the signals through the AND circuits 16 and 23. Accordingly, the signals "1" are not produced at the output lines 19 and 25 of the conversion circuit 1 for the upper and lower keyboard signals UE and LE. Accordingly, the signals as designated by the keyboard to which the depressed key belongs, i.e. any one of UE′, LE′ and PE′ are supplied to the harmonic coefficient memory 9.

In the above embodiment, in case the coupler effect is provided, the AND circuits 14 and 22 are thus disenabled, but the lower or pedal keyboard signal LE or PE is introduced from the tone production assignment circuit 4 through lines 27 or 28 to one of the input terminals of the OR circuit 18 or 24 and then through the OR circuit 18 or 24 and is produced at the output line 19 or 25 with the result that the tones corresponding to the depressed keys are always produced even through the conversion circuit 1. For example, assuming that the upper and lower keyboard coupler selection switch 13 is closed and that the key depressed of the upper keyboard is assigned to a certain channel and also that the depressed key of the lower keyboard is assigned to another channel, the coupler tones of the upper and lower keyboards are produced at the certain channel, whereas the tones of the lower keyboard are produced at the other channel.

It will be understood from the foregoing description that the circuit arrangement of the conversion circuit 1 is not limited to that illustrated in FIG. 1. The input keyboard signals UE, LE and PE may be converted to any of the keyboard designation signals UE′, LE′ and PE′ by properly varying the combinations of the logical elements. Further, the foregoing description has been made with regard to a case wherein a single conversion logic 29 surrounded by a broken line in FIG. 1 is provided. A similar conversion logic may also be separately provided for accomplishing, for example, "the coupler effect between the upper and lower keyboards upon depression of the keys of the lower keyboard" and "the coupler effect between the pedal keys of the pedal keyboard". Thus, the coupler effects in relation to the entire keyboards can be realized.

Figure 4:
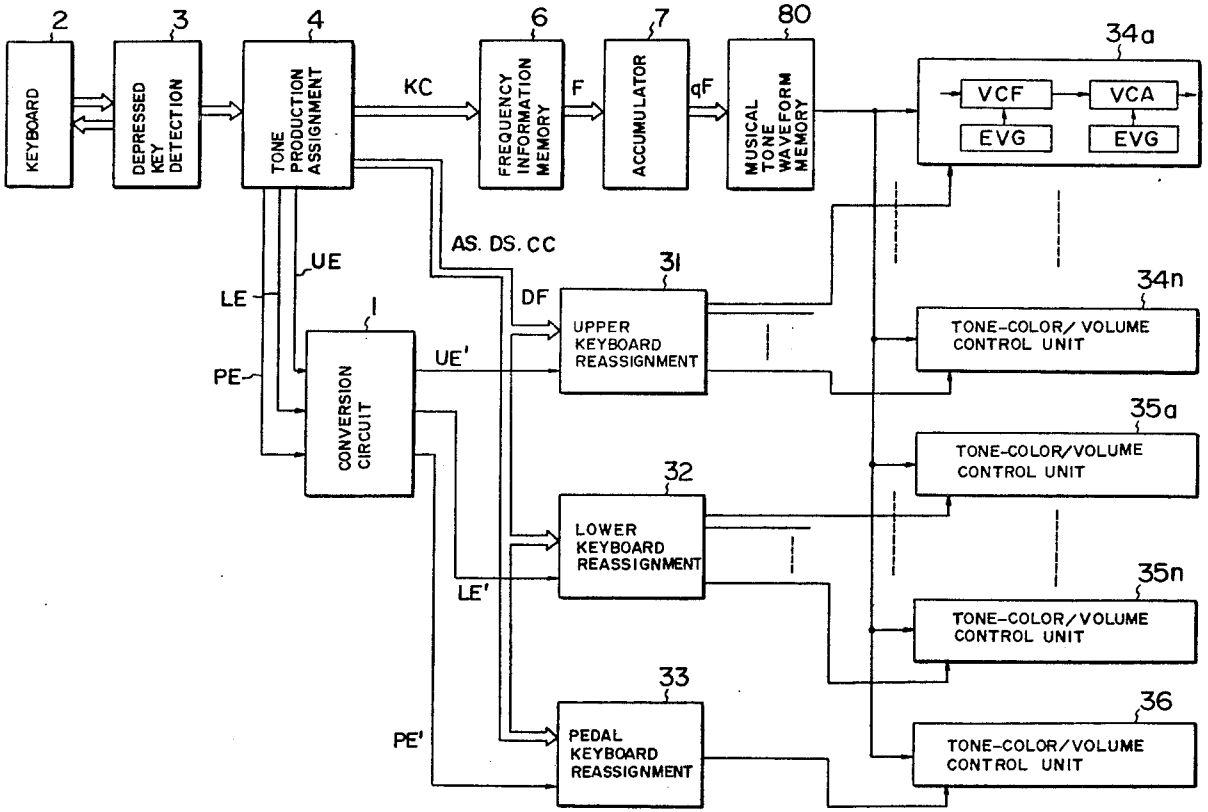
FIG. 4 is a block diagram showing another embodiment of the electronic musical instrument according to the invention.

FIG. 4 indicates a block diagram of another embodiment of the electronic musical instrument constructed in accordance with the present invention. The conversion circuit 1 of this embodiment may employ the same arrangement 1 disclosed in FIG. 1 or may also be those described above. Keyboards 2, depressed key detection circuit 3, tone production assignment circuit 4, frequency information memory 6 and frequency information accumulator 7 in this embodiment may be the same as those shown in FIG. 1.

More specifically, the instrument shown in FIG. 4 is constructed in such a manner that the tone assigned to any channel in the assignment circuit 4 regardless of the kind of keyboard is reassigned to any of the specific number of channels by means of reassignment circuits 31, 32, and 33 in the separate systems for the respective keyboard kinds so that the tone-colors of the musical tones at the respective channels may be controlled in static state using a voltage-controlled filter VCF or a voltage controlled amplifier VCA, etc.

Such circuit arrangement has been disclosed in the copending U.S. Patent application Ser. No. 678,709 entitled "Electronic Musical Instrument" assigned to the same assignee. More particularly, an upper keyboard reassignment circuit 31 serves the functions of reassigning a signal appearing at a channel time at which the upper keyboard designation signal UE′ is "1" to any of stationary channels for the upper keyboard. Alternatively stated, the upper keyboard reassignment circuit 31 causes one tone-color/volume control unit of tone-color/volume control units **34*a* through 34*n* corresponding to aforesaid stationary channel to receive the tone signal applied from a musical tone waveform memory 80** at the corresponding channel time for operating the voltage-controlled filter VCF and the voltage-controlled amplifier VCA therein in response to the control voltage set by a control voltage generator EVG in the units so as to control the tone-color/volume and the like of the tone signal to obtain a desired musical tone.

A lower keyboard reassignment circuit 32 functions to reassign the tone signal to one of the tone-color/-volume control units **35*a* through 35*n* corresponding to the respective stationary channels for operating in the same manner as described above with regard to the upper keyboard reassignment circuit 31. A pedal keyboard reassignment circuit 33 serves the functions of reassigning the tone signal to the tone-color/volume control unit 36 for operating in the same manner as described above with respect to the upper and lower keyboard reassignment circuits 31 and 32**.

The musical tone waveform memory 80 stores amplitudes of sampled musical tone waveforms at the respective sampling points successively and sequentially.

Thus, it will be understood from the foregoing description that the tone-color and volume of the musical tones are controlled in response to the reassignment operations of the reassignment circuits 31 and 33 separately for the respective keyboards depending upon the kinds of the keyboards.

The conversion circuit 1 of this example is connected between the tone production assignment circuit 4 and the reassignment circuits 31 and 33. Accordingly, in case where the upper and lower keyboard coupler selection switch 13 shown in FIG. 1, for example, is closed, when the upper keyboard signal UE representing that the key of the upper keyboard is depressed becomes "1", both the upper and lower keyboard designation signals UE' and LE' become "1" and are provided at the output lines of the conversion circuit 1. Then, the upper and lower keyboard reassignment circuits 31 and 32 operate to reassign the tone signal to the corresponding tone-color/volume control units 34 and 35, respectively. Thus, the same tone signal is applied from the musical tone waveform memory 80 to any one of the upper keyboard tone-color/volume control units 34*a* through 34*n* and any one of the lower keyboard tone-color/volume control units 35*a* through 35*n* for separately controlling the tone-color and volume of the musical tones. Thus, the tones of the upper and lower keyboards are simultaneously produced so as to obtain the coupler effect.

What is claimed is:

1. In an electronic musical instrument of a type having at least two keyboards, means for generating, in response to depression of a key in any one of said keyboards, a multibit key code containing certain note information bits identifying the musical note associated with the depressed key and having other keyboard information bits identifying the specific keyboard which contains the depressed key, and tone production means for producing a musical tone according to said key code and including note production circuitry for producing a musical note having a note frequency established by said certain note information bits, and tone color control circuitry, connected to the output of said note production circuitry, for controlling the tonal quality of the produced musical tone depending on the keyboard designated by said information bits, the improvement for providing a coupler effect comprising:

conversion means, responsive to only the keyboard information bits of the key code generated in response to depression of a key, for producing both an unconverted signal representing the keyboard designated by the keyboard information bits of said generated key code and a converted signal representing a different keyboard, said tone color control circuitry receiving and being responsive to both the unconverted signal and to the converted signal so as to produce simultaneously a combined musical tone having a note frequency established by the certain note information bits and combined tonal quality related both to the keyboard to which the depressed key belongs and to a different keyboard.

2. An electronic musical instrument as defined in claim 1 and having upper and lower keyboards, wherein said conversion means, upon receipt of a signal generated in response to depression of a key in said upper keyboard, converts the keyboard information bits of said signal to both an unconverted signal representing the upper keyboard and a converted signal representing a lower keyboard and simultaneously delivers to said tone color control circuitry both the converted signal and the unconverted signal.

3. An electronic musical instrument as defined in claim 1 and having lower and pedal keyboards, wherein said conversion means, upon receipt of a signal generated in response to depression of a key in said lower keyboard, converts the keyboard information bits of said signal to both an unconverted signal representing the lower keyboard and a converted signal representing a pedal keyboard and simultaneously delivers to said tone color control circuitry both the converted signal and the unconverted signal.

4. An electronic musical instrument as defined in claim 1 wherein said note production circuity includes a harmonic waveform memory read out at a rate determined by a frequency number F corresponding to said certain note information bits, and wherein said tone color control circuity comprises different sets of harmonic coefficient means for scaling and combining the harmonic waveforms read from said waveform memory, and gate means for enabling selected different ones of said sets in response to receipt of different keyboard information signals from said conversion means.

5. An electronic musical instrument as defined in claim 1 wherein said note production circuitry comprises a musical tone waveform memory read out at a rate determined by a frequency number corresponding to said certain note information bits, and wherein said tone color control circuit comprises:

a plurality of tone color control units each adapted to impart a respective selected tonal quality to the tone waveform read out from said memory, and assignment means for assigning, in response to receipt respectively of both said unconverted signal and said converted signal, a pair of tone color control units to impart to the same waveform two different tonal qualities corresponding respectively to the keyboards designated by said unconverted and converted signals.

6. An electronic musical instrument as defined in claim 1 wherein said conversion means comprises:

a set of control lines each corresponding to a respective keyboard, a decoder for receiving and decoding said keyboard information bits to produce said unconverted signal on the line corresponding to the keyboard containing the depressed key, a switch circuit for selecting the desired keyboard coupling; and AND-gate means, enabled by operation of said switch circut, for passing the unconverted signal from the line corresponding to the keyboard of the depressed key through onto the line associated with a different, coupled keyboard, said passed signal thereby becoming said converted signal.

* * * * *